US011491076B2

(12) United States Patent
Rise

(10) Patent No.: US 11,491,076 B2
(45) Date of Patent: Nov. 8, 2022

(54) PROTECTIVE COVER SYSTEM

(71) Applicant: Power Massage Products Inc, Fort Collins, CO (US)

(72) Inventor: Mark J. Rise, Fort Collins, CO (US)

(73) Assignee: Power Massage Products Inc, Fort Collins, CO (US)

( * ) Notice: Subject to any disclaimer, the term of this patent is extended or adjusted under 35 U.S.C. 154(b) by 105 days.

(21) Appl. No.: 15/712,021

(22) Filed: Sep. 21, 2017

(65) Prior Publication Data

US 2019/0083352 A1 Mar. 21, 2019

(51) Int. Cl.
*A61H 7/00* (2006.01)

(52) U.S. Cl.
CPC ..... *A61H 7/005* (2013.01); *A61H 2201/0107* (2013.01); *A61H 2201/0153* (2013.01); *A61H 2201/123* (2013.01); *A61H 2201/1215* (2013.01); *A61H 2201/16* (2013.01); *A61H 2201/1673* (2013.01); *A61H 2205/081* (2013.01)

(58) Field of Classification Search
CPC . A61H 1/00; A61H 1/005; A61H 7/00; A61H 7/002; A61H 7/003; A61H 7/004; A61H 7/005; A61H 23/00; A61H 23/02–0263; A61H 23/04; A61H 39/007; A61H 2205/081; A61H 23/006; A61H 2201/1683–1697
See application file for complete search history.

(56) References Cited

U.S. PATENT DOCUMENTS 2,395,537 A * 2/1946 Crosby ..... A47L 11/125 451/514
2,414,321 A * 1/1947 Miller ..... A47K 7/028 15/188
2,664,884 A * 1/1954 La Verne ..... A61H 7/002 601/135
3,710,785 A * 1/1973 Hilger ..... A61H 23/0263 601/73
3,799,154 A * 3/1974 Knop ..... A61H 23/0263 601/57
4,722,326 A * 2/1988 Ruderian ..... A61M 37/0092 401/2
4,935,972 A * 6/1990 Brady ..... A47C 27/081 4/575.1
5,347,673 A * 9/1994 Nickels, Jr. ..... A47L 11/4069 403/348
5,489,161 A 2/1996 Sugita et al.
(Continued)

OTHER PUBLICATIONS

Autogeek. Buffer Bonnets. Website, http://www/autogeek.net, originally downloaded Aug. 15, 2017, 3 pages total.
(Continued)

*Primary Examiner* — Justine R Yu
*Assistant Examiner* — Matthew D Ziegler
(74) *Attorney, Agent, or Firm* — Craig R. Miles; CR Miles P.C.

(57) ABSTRACT

A protective member having a flexible member body defining an interior space adapted to receive a motion element and which extends to a peripheral margin releasably attachable to an external surface of a housing enclosing a drive unit operable to move the motion element inside of the flexible member body. whereby the protective member prevents entanglement of hair or fur with the drive unit or motion element.

4 Claims, 11 Drawing Sheets

(56) References Cited

U.S. PATENT DOCUMENTS 5,848,559 A * 12/1998 Harrill ..... A61H 23/0254 74/558
6,093,164 A * 7/2000 Davis ..... A61H 23/0263 601/46
6,647,572 B2 * 11/2003 Lee ..... H01L 31/022408 257/E31.125
6,679,857 B1 * 1/2004 Bastia ..... A61H 7/005 601/72
7,261,699 B1 * 8/2007 Wu ..... A61H 15/0085 601/112
8,185,986 B2 * 5/2012 Grimes ..... A61H 1/005 5/600
8,197,307 B1 * 6/2012 Luna ..... B24D 13/147 451/159
8,523,793 B1 * 9/2013 Waldon, Sr. ..... A61H 23/02 601/46
8,764,688 B1 * 7/2014 Nauman ..... A61H 23/0263 601/46
8,863,327 B1 * 10/2014 Winn ..... A47G 9/007 5/490
9,883,982 B2 * 2/2018 McGushion ..... A61H 23/02
10,172,762 B1 * 1/2019 Branch ..... A61H 23/02
2003/0024558 A1 * 2/2003 Lewis ..... A61H 3/02 135/72
2004/0077978 A1 * 4/2004 Nelson ..... A61H 1/0237 601/70
2006/0020236 A1 * 1/2006 Ben-Nun ..... A61F 13/00987 602/60
2006/0143875 A1 * 7/2006 Kunold ..... B65D 33/1616 24/30.5 R
2007/0255187 A1 * 11/2007 Branch ..... A61F 7/02 601/15
2008/0033327 A1 * 2/2008 Evans ..... A61H 23/0263 601/57
2009/0204061 A1 * 8/2009 Pomposelli ..... A61H 7/005 604/22
2009/0222986 A1 * 9/2009 Hamilton ..... A47C 31/10 5/488
2010/0191159 A1 * 7/2010 Ellin ..... A61H 23/0263 601/58
2010/0204625 A1 * 8/2010 Yamamoto ..... A61H 1/0292 601/151
2014/0251334 A1 * 9/2014 Kramer ..... A61M 16/0875 128/205.25
2015/0359701 A1 * 12/2015 Moyer ..... A61H 15/0092 601/131
2016/0361224 A1 * 12/2016 Ramakrishna ..... A61H 9/0092
2017/0290736 A1 * 10/2017 Idris ..... A61H 23/02
2019/0183724 A1 * 6/2019 Sifferlin ..... A61H 23/0218

OTHER PUBLICATIONS

Kartek. Outerwears Round Cylindrical Pre-Filter Cover 14" Diameter 3" Tall With The Top. Website, https://www.kartek.com, originally downloaded Aug. 15, 2017, 3 pages total.
Waterskis. Mastercraft Spare Tire Cover. Website, https://www.waterskis.com, originally downloaded Aug. 15, 2017, 3 pages total.

* cited by examiner

PROTECTIVE COVER SYSTEM

I. FIELD OF THE INVENTION

A protective member having a flexible member body defining an interior space adapted to receive a motion element and which extends to a peripheral margin attachable to a housing enclosing a drive unit operable to move the motion element inside of the flexible member body.

II. SUMMARY OF THE INVENTION

A broad object of the invention can be to provide a protective cover system including one or more of a housing, a drive unit disposed in the housing, a motion element coupled to the drive unit and disposed external to the housing, and a protective member defining a protective member interior space adapted to receive the motion element and which extends to a peripheral margin attachable to the housing.

Another broad object of the invention can be to provide a method for making a protective cover system including one or more of obtaining a housing, disposing a drive unit in the housing, coupling a motion element to the drive unit and disposing the motion element external to the housing, and providing a protective member which defines a protective member interior space adapted to receive the motion element and which extends to a peripheral margin attachable to the housing.

Another broad object of the invention can be to provide a method for using a protective cover system including one or more of obtaining a protective cover system including a housing, a drive unit disposed in the housing, a motion element coupled to the drive unit and disposed external to the housing, and a protective member defining a protective member interior space adapted to receive the motion element and which extends to a peripheral margin attachable to the housing, disposing the motion element in the protective member interior space, and attaching the peripheral margin of the protective member to the housing.

Another broad object of the invention can be to provide a method of using a protective cover system including obtaining a housing, a drive unit disposed in the housing, a motion element coupled to the drive unit and disposed external to the housing and disposed inside of protective member interior space of a protective member which extends to a peripheral margin attached to the housing, engaging the protective member to an object; operating the drive unit to move the motion element inside of the protective member.

Naturally, further objects of the invention are disclosed throughout other areas of the specification, drawings, photographs, and claims.

III. BRIEF DESCRIPTION OF THE DRAWINGS

IV. DETAILED DESCRIPTION OF THE INVENTION

Figure 1:
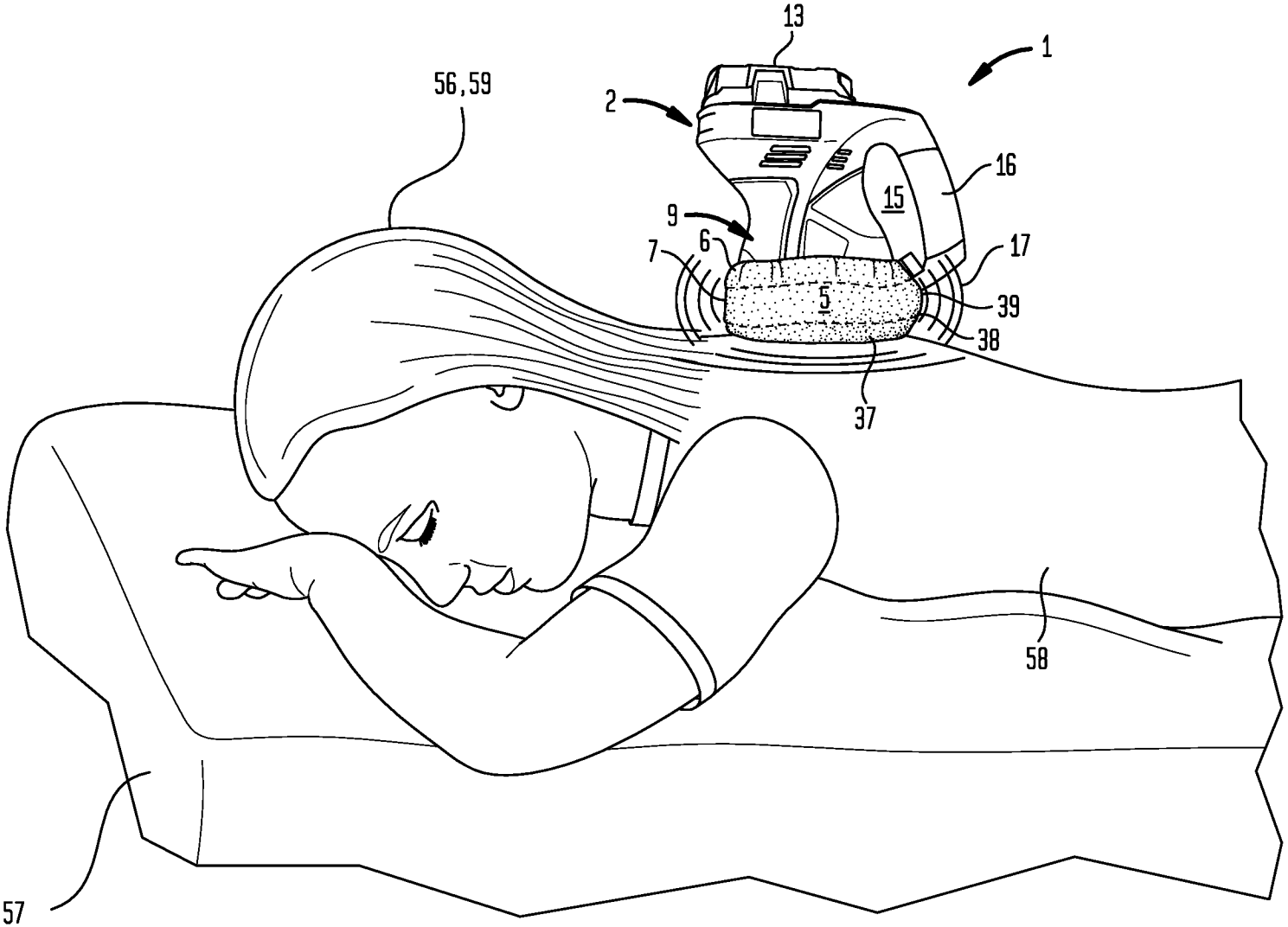
FIG. 1 is a perspective view of a particular embodiment of a protective cover system.
Figure 2:
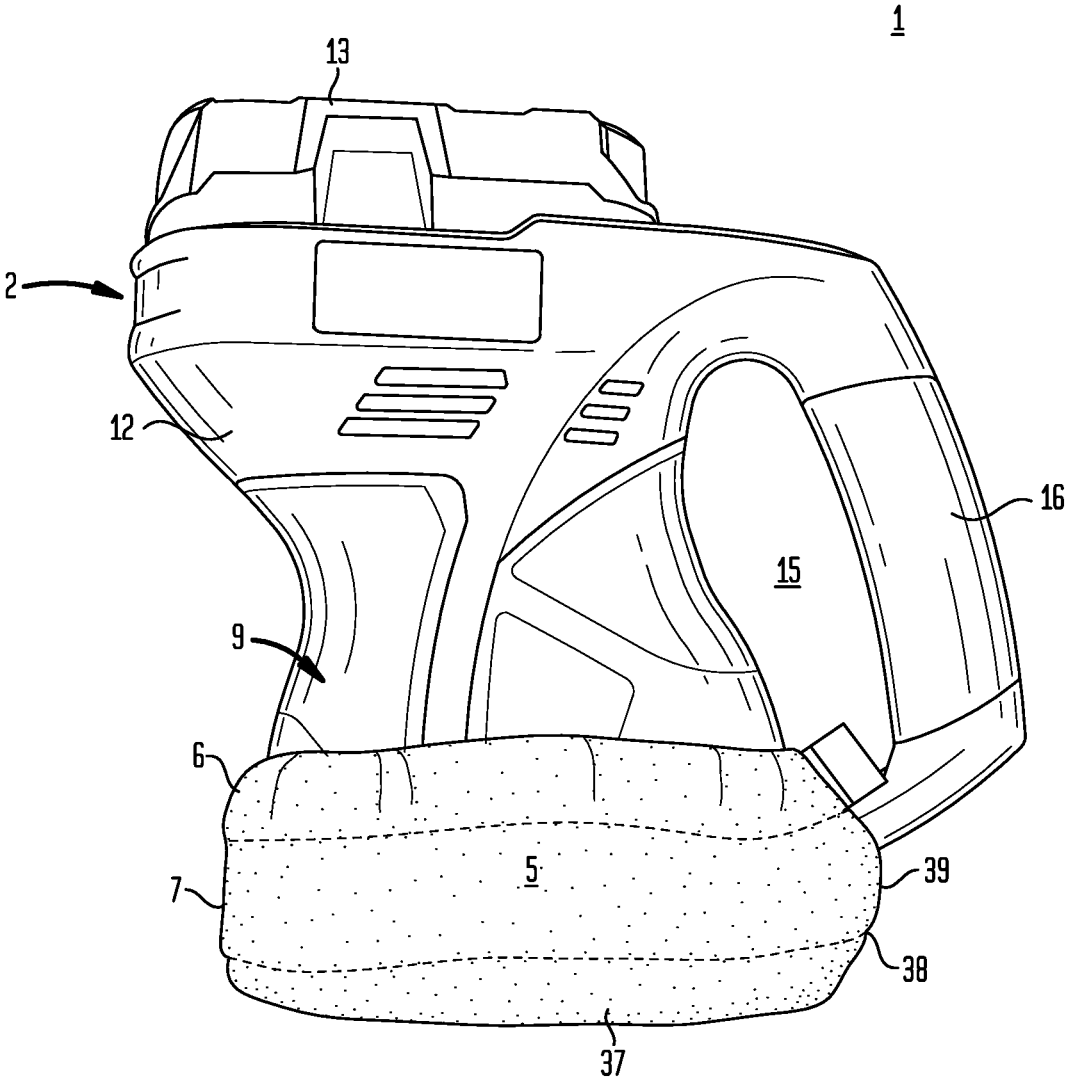
FIG. 2 is a side elevation view of a particular embodiment of a protective cover system.
Figure 3:
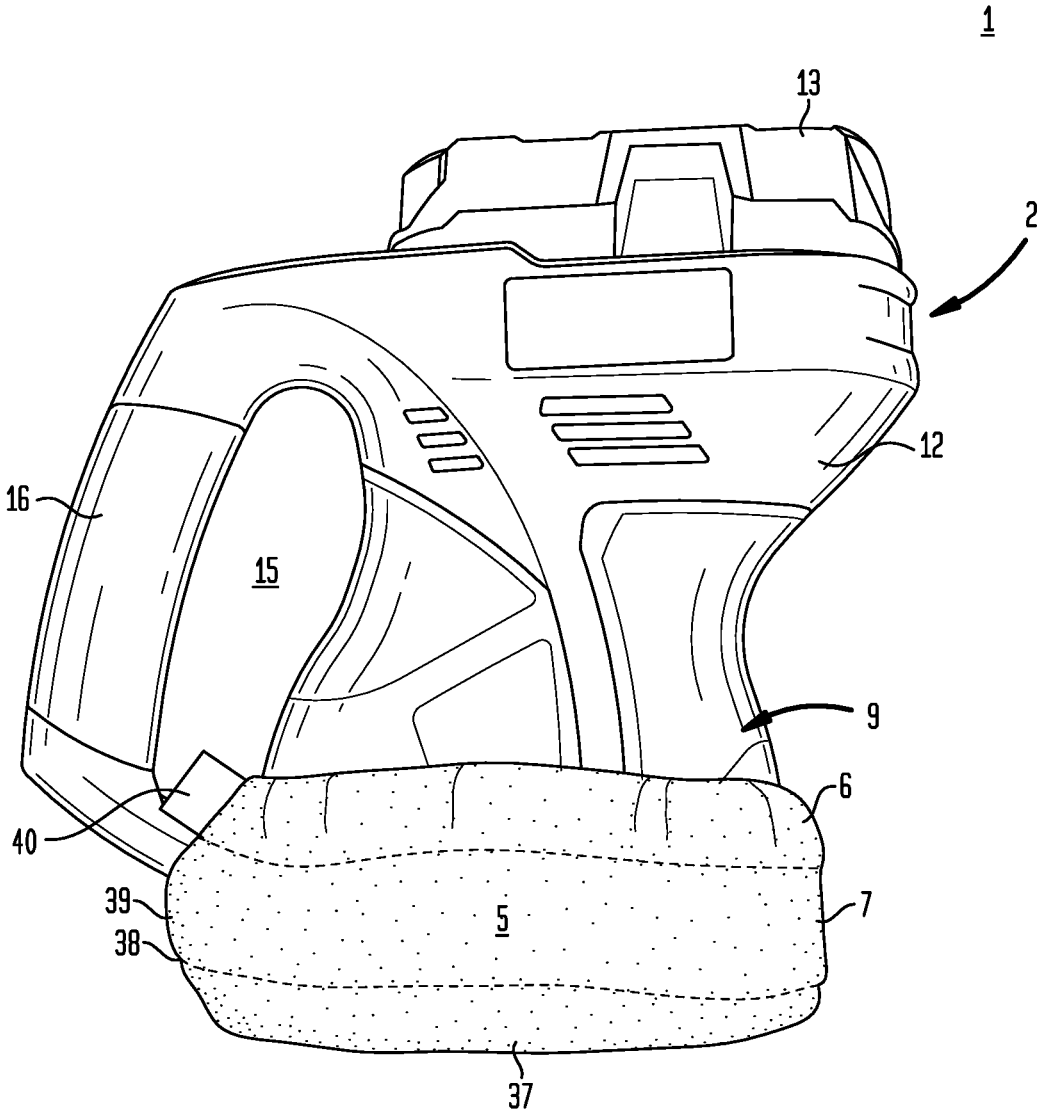
FIG. 3 is an opposite side elevation view of a particular embodiment of a protective cover system.
Figure 4:
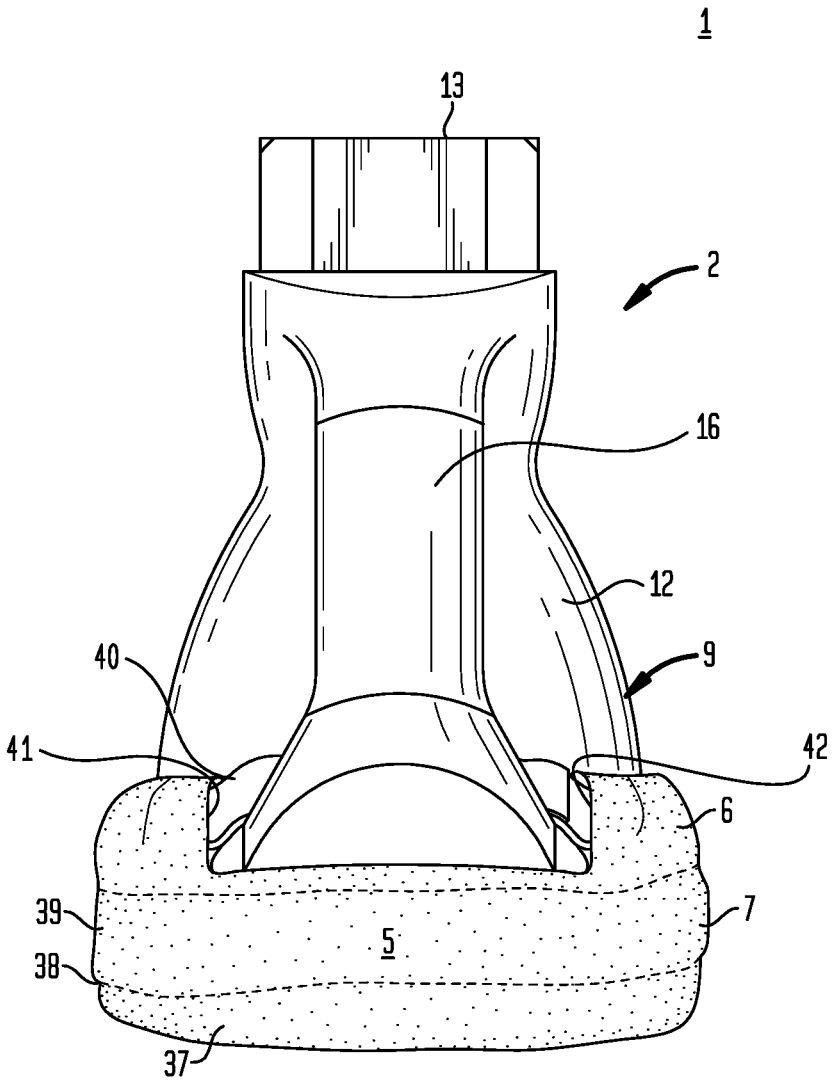
FIG. 4 is a back elevation view of a particular embodiment of a protective cover system.
Figure 5:
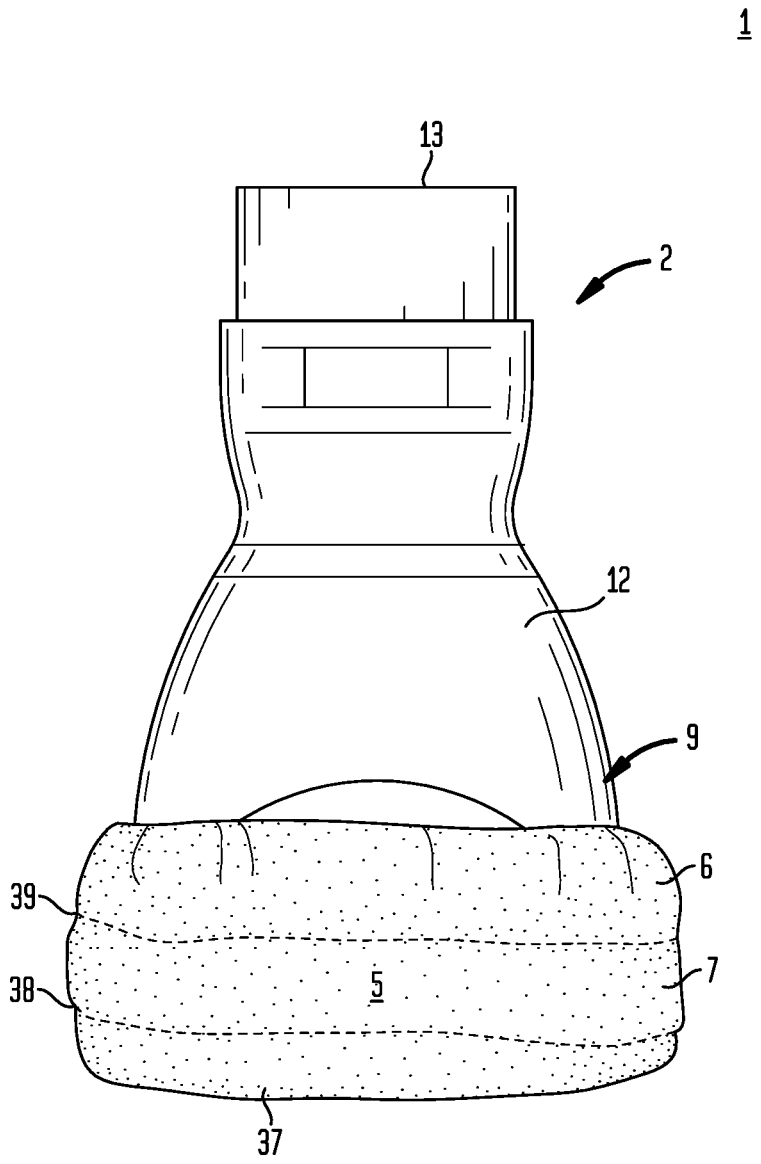
FIG. 5 is a front elevation view of a particular embodiment of a protective cover system.
Figure 6:
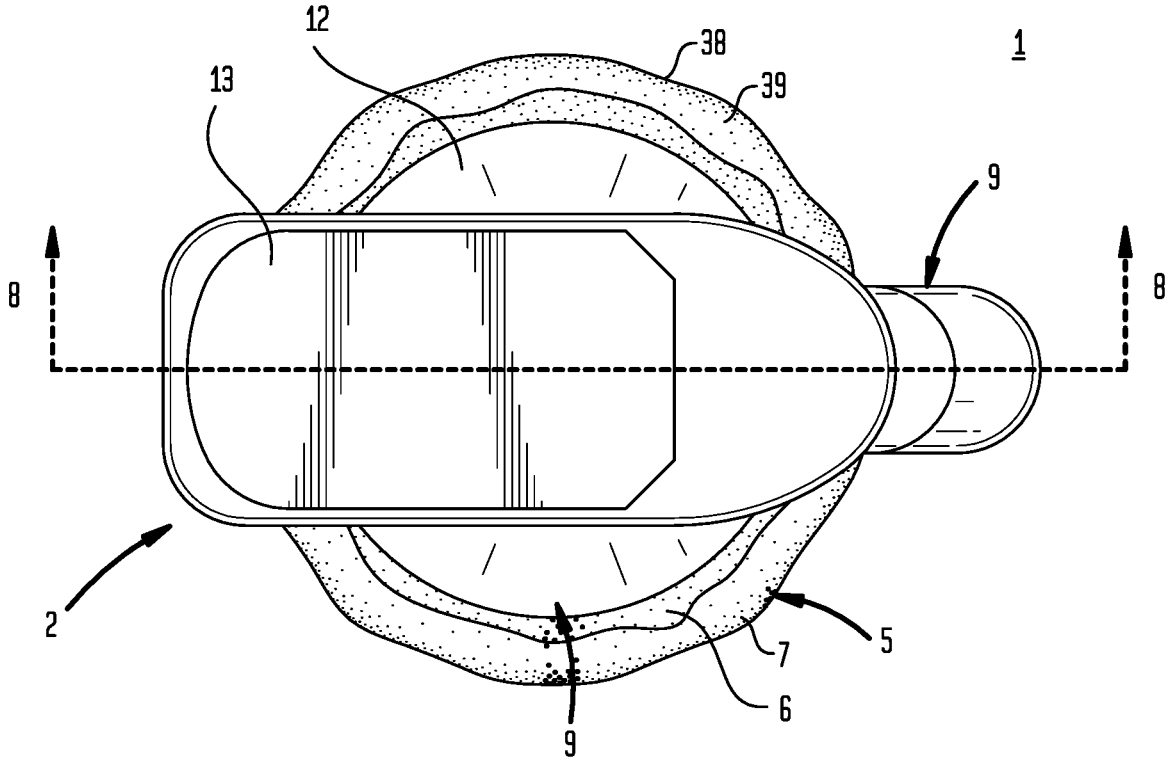
FIG. 6 is a top plan view of a particular embodiment of a protective cover system.
Figure 7:
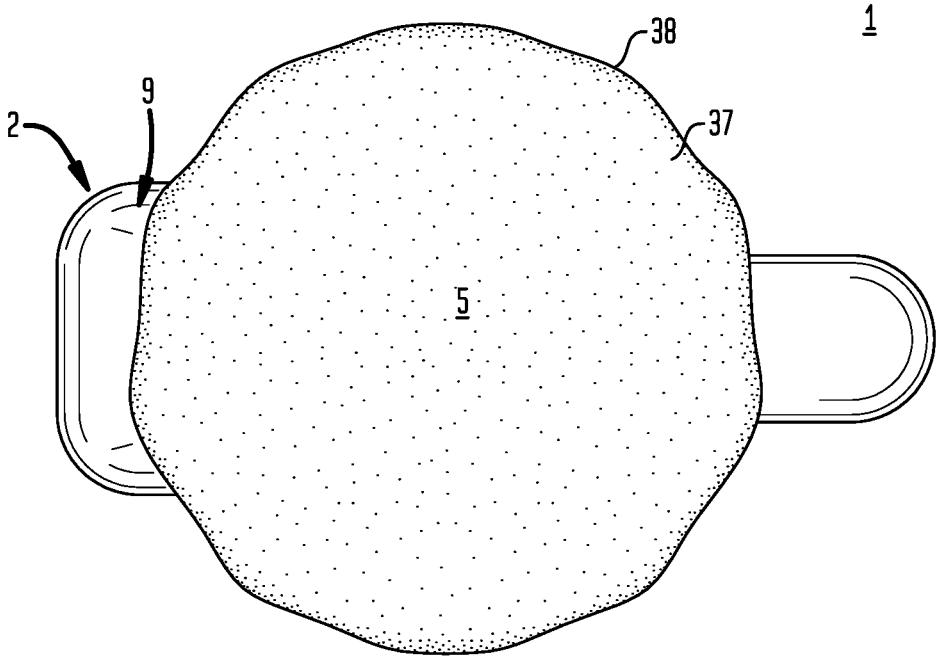
FIG. 7 is a bottom plan view of a particular embodiment of a protective cover system.

In general, a protective cover system (1) including one or more of: a housing (2), a drive unit (3) disposed in the housing (2), a motion element (4) coupled to the drive unit (3), and a protective member (5) disposed about the motion element (4) and extending to a peripheral margin (6) attachable or securable to the housing (2). Specifically, a protective member (5) having a flexible member body (7) defining an interior space (8) adapted to receive a motion element (4), and which extends to a peripheral margin (6) which can be attached or otherwise secured to a housing (2) of a drive unit (3) which operates to move the motion element (4) inside of the flexible member body (7).

Figure 8:
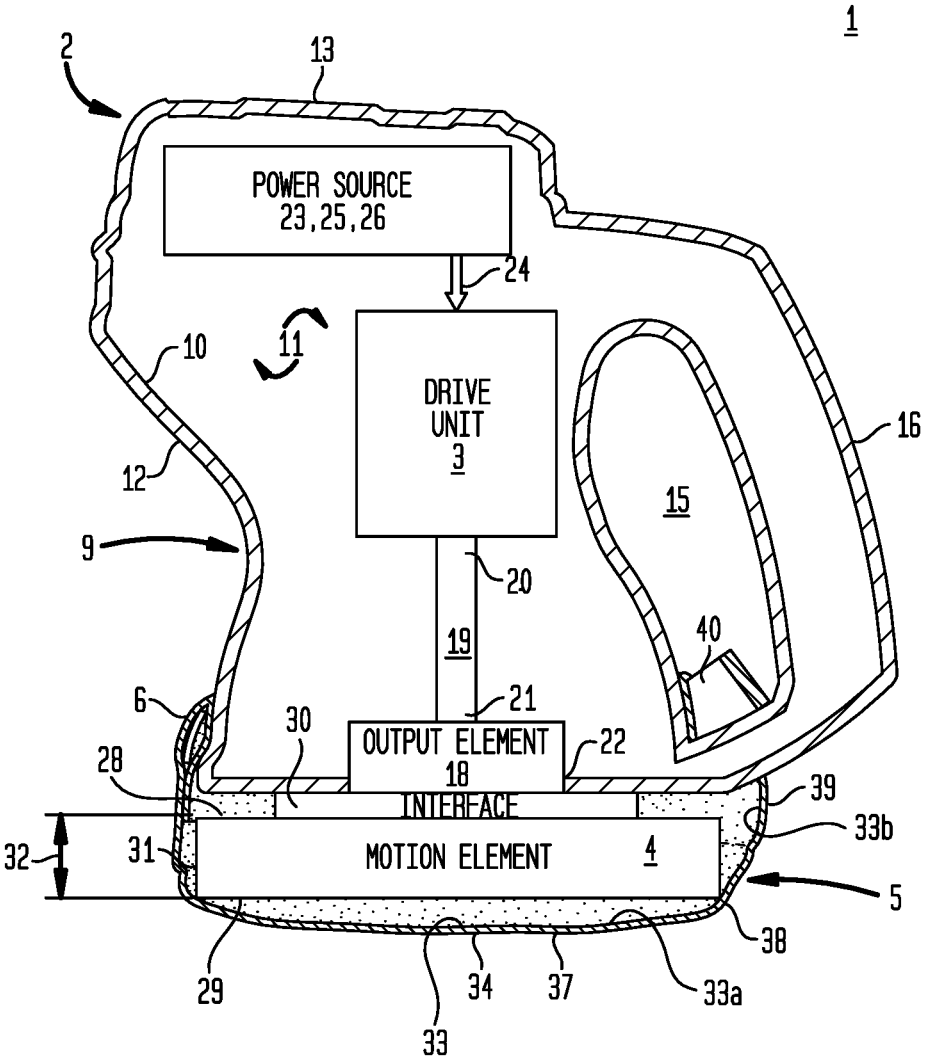
FIG. 8 is a cross-sectional view 7-7 of a particular embodiment of a protective cover system.

Referring generally to FIGS. 1 through 11, particular embodiments of the protective cover system (1) can include a housing (2). The housing (2) can define a housing external surface (9) and a housing internal surface (10) (as shown in the example of FIG. 8). The housing external surface (9) can take any of a wide and numerous variety of configurations which allow the housing internal surface (10) to define a housing interior space (11) adapted to receive or support a drive unit (3), and which does not obstruct operation of the drive unit (3) disposed within the housing interior space (11) or movement of a motion element (4) disposed external to the housing (2). In particular embodiments, the housing (2) can, but need not necessarily, include one or more housing sidewalls (12) which join a housing top (13), and a housing bottom (14). As shown by the illustrative example of FIGS. 2 through 8, a housing (2) can include a housing top (13) and a housing bottom (14) joined by a housing sidewall (14) which can, but need not necessarily, further include a pass-through aperture (15) which defines a generally vertical handle (16) configured to be grasped by a portion of a hand located in the pass-through aperture (15). The illustrative examples of the housing (2) and housing external surface (9) are not intended to preclude embodiments in which the housing (2) has a different configuration, rather, the illustrative examples are intended to provide the person of ordinary skill in the art sufficient information to make and use numerous varied configurations of the housing (2).

Now referring primarily to FIG. 8, a drive unit (3) can be disposed within the housing interior space (11) defined by the housing internal surface (10). The drive unit (3) can operate to provide rotational torque, longitudinal displacement, latitudinal displacement, vertical displacement, or combinations thereof, to directly or indirectly, generate movement (17) in a motion element (4) such as linear (whether unidirectional or reciprocal), rotatory, oscillatory or orbital movement(s), or combinations thereof. The drive unit (3) can include a driven output element (18) which couples the drive unit (3), whether directly or indirectly, to the motion element (4).

As shown by the illustrative example of FIG. 8, the driven output element (18) can, but need not necessarily, be a drive shaft (19) having a shaft length disposed between a drive shaft first end (20) coupled directly or indirectly to the drive unit (3) and a drive shaft second end (21) coupled directly or indirectly to a motion element (4). The drive shaft (19) can extend from the drive unit (3) through a housing aperture (22) disposed in the housing bottom (14) (or other part of the housing (2)) to locate the drive shaft second end (21) external to the housing (2). The motion element (4) can be coupled to the drive shaft second end (22) to dispose the motion element (4) external to the housing (2).

Again, referring primarily to FIG. 8, the drive unit (3) can further be electrically coupled to a power source (23). The power source (23) can provide power (24) to the drive unit (3) which can be switched to place the drive unit (3) in the operable or inoperable condition. The power source (23) can be disposed within the housing (2) or disposed external to the housing (2). In particular embodiments, the power source (23) can be a direct current source (25), such as dry cell battery (26) including or consisting of: a nickel cadmium battery, a nickel metal hydride battery, a lithium ion battery, and combinations thereof. In particular embodiments, the power source (23) can be an alternating current source (27) disposed external to the housing (2) such as 110 volts alternating current transmitted by a municipal distribution grid, and which voltage can be increased or decreased with a transformer or converted to direct current using an inverter.

Figure 9A:
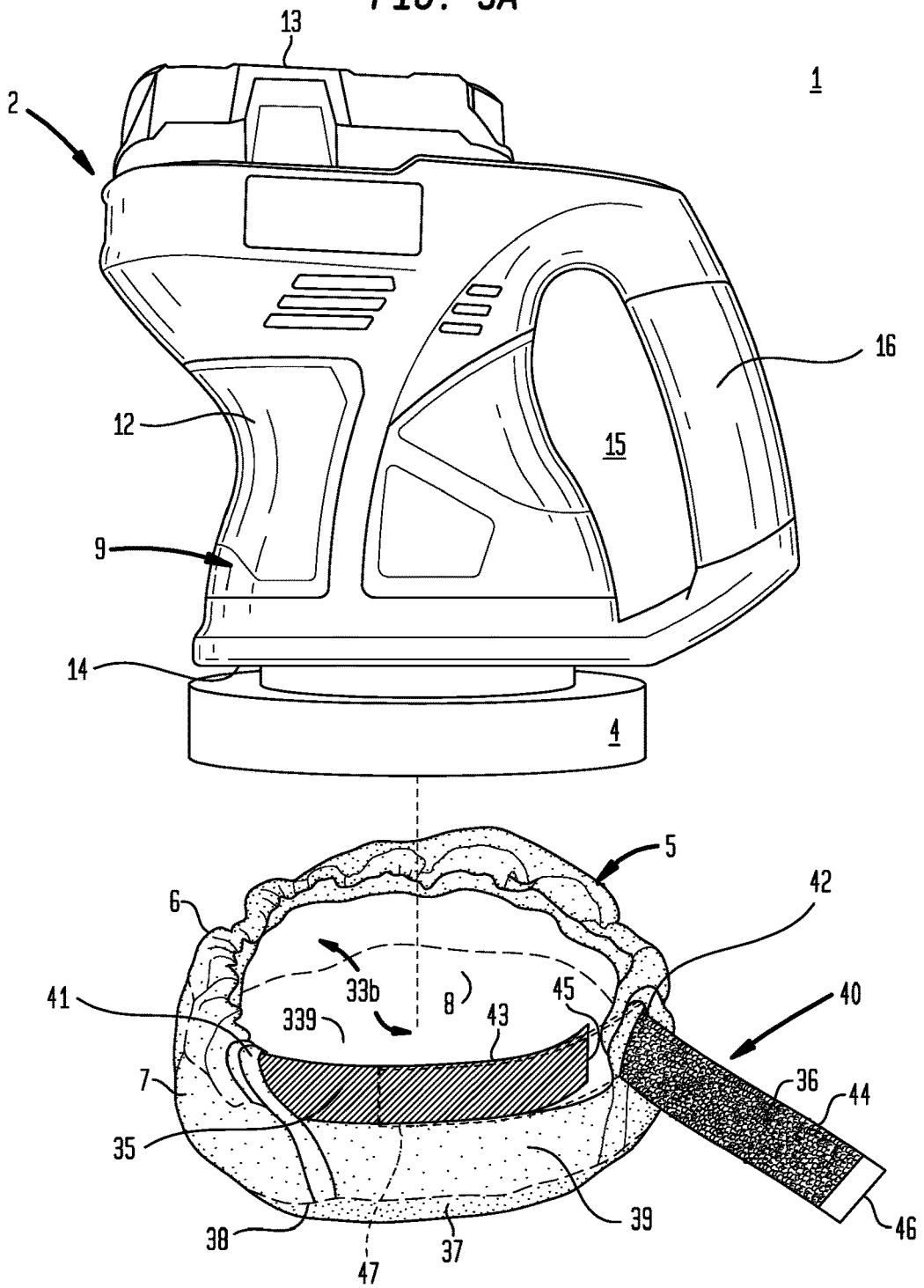
FIG. 9A is an exploded view of a particular embodiment of a protective cover system.
Figure 9B:
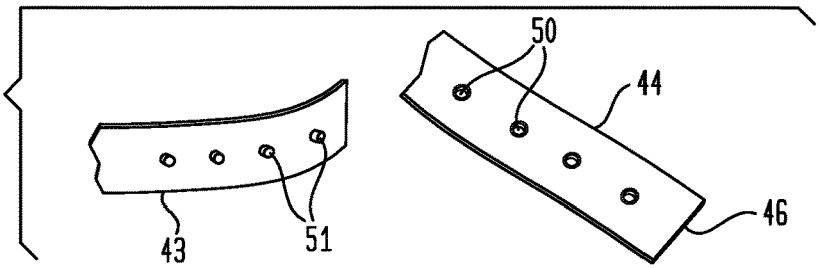
FIG. 9B is a perspective view of a particular embodiment of a peripheral margin adjustment assembly.
Figure 10:
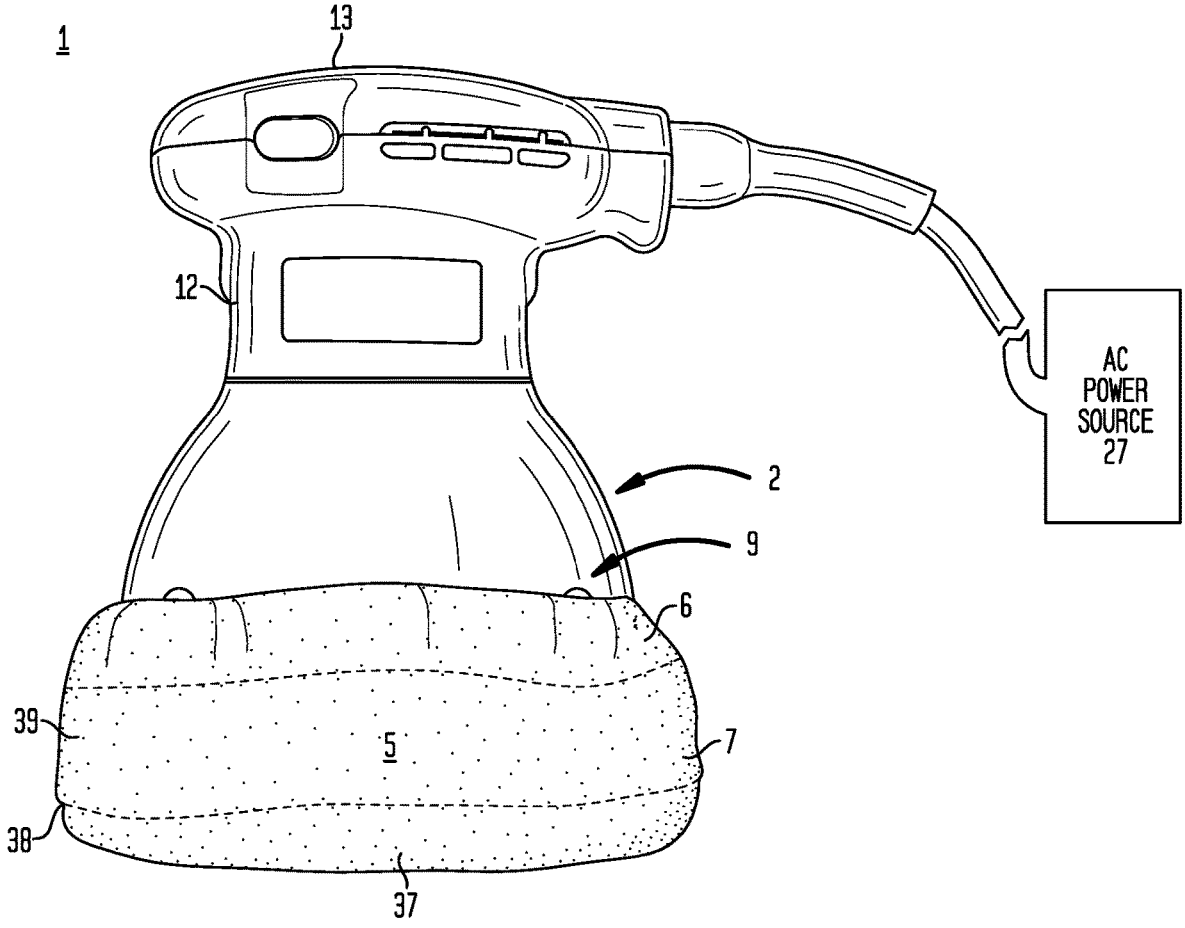
FIG. 10 is a side view of another particular embodiment of a protective cover system.
Figure 11:
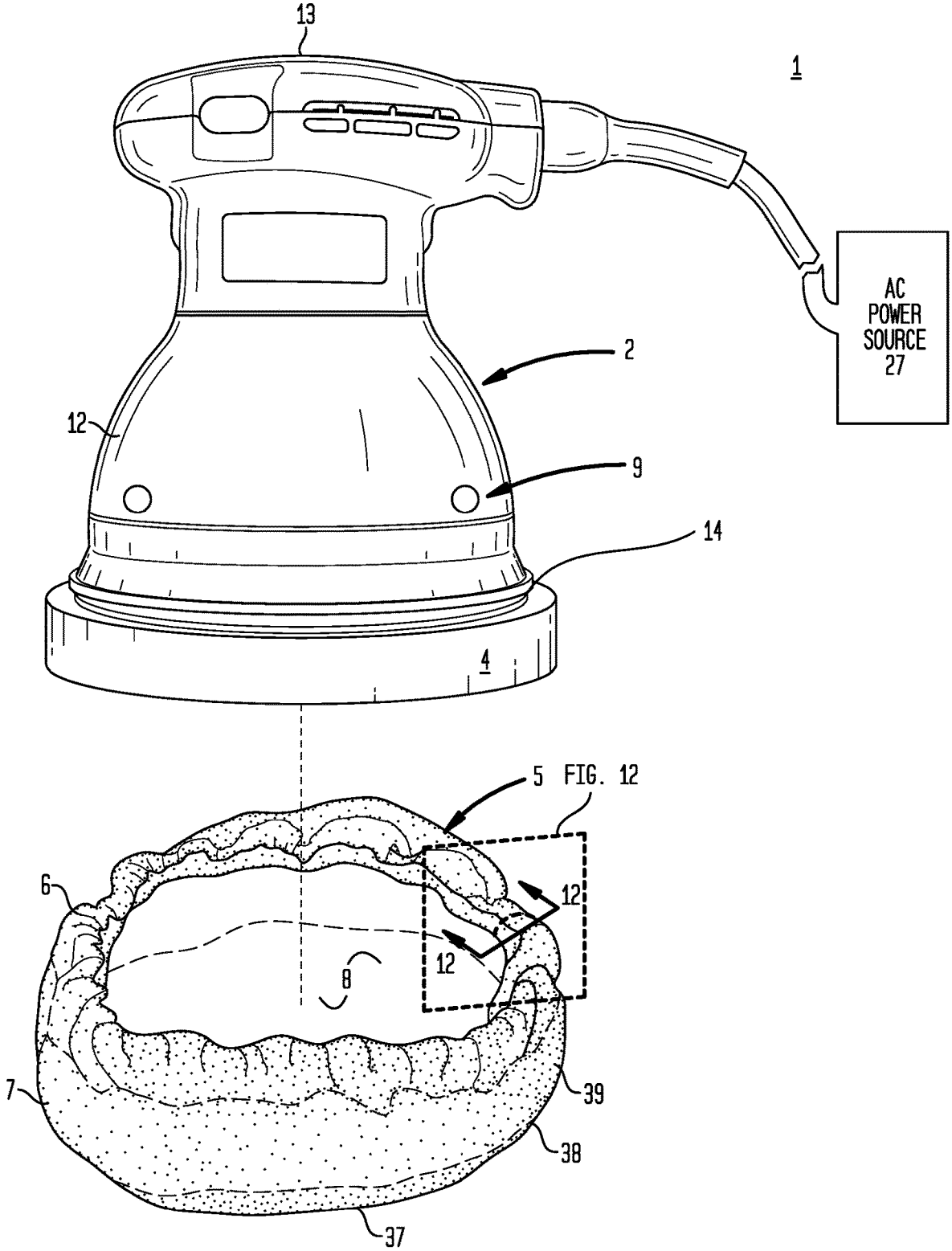
FIG. 11 is an exploded view of another particular embodiment of a protective cover system.

Now referring primarily to FIGS. 8, 9 and 11, embodiments can include a motion element (4) which moves in response to operation of the drive unit (3). The motion element (3) can be disposed external to the housing (2). The motion element (4), as described above, can move in numerous varied directions or patterns, such as linear, reciprocal, rotatory, oscillatory or orbital movement, or combinations thereof. The motion element (4), as shown in the illustrative examples of FIGS. 8 and 9, can include a first face (28) opposite a second face (29). The first face (28) can further include a driven output element interface (30) which couples and transfers forces from the driven output element (18) to the motion element (4) and allows interchangeability of a plurality of motion elements (4). The first face (28) and the second face (29) can be joined by a peripheral edge (31). The motion element (4) can have a material thickness (32) disposed between the first face (28) and the second face (29) which can vary depending on the application between 0.25 inch to 1 inch; although this range does not preclude embodiments which may be of greater or lesser material thickness (32). While the motion element (4) shown in FIGS. 8 and 10 has a generally circular peripheral edge (31); this is not intended to preclude embodiments of the motion element (4) having a peripheral edge (31) which defines an oval, a square, a rectangle, a triangle, a pentagon, or any other peripheral edge (31) configuration depending on the application. The motion element (4) can include one or more of a wide variety of materials or combinations thereof having a wide range of durometer to correspondingly generate a wide range of geometries upon application of forces to the second face (29). Shore A durometer of about 20 to about 70 can provide a useful range of hardness allowing for a wide range of geometries of the first face (28) upon normal application of forces by a user, as further described below.

Now generally referring to FIGS. 1 through 11, embodiments can include a protective member (5), whether separate from, or as part of, the protective cover system (1). The protective member (5) can have a flexible member body (7) having a flexible body internal surface (33) opposite a flexible body external surface (34) which extends to a peripheral margin (6). The flexible body internal surface (33) defines a protective member interior space (8) having a volume sufficient to receive the motion element (4) and permit movement of the motion element (4) in response to operation of the drive unit (3). The flexible member internal surface (33) can be disposed proximate or engaged to the second face (29) of the motion element (4). The peripheral margin (6) of the protective member (5) can be secured or attached to the housing external surface (9) (as shown in the illustrative examples of FIGS. 1 and 9). Securement or attachment of the peripheral margin (6) to the housing external surface (9) can be achieved by friction fit of the peripheral margin (6) to the housing (2), adhesive disposed between the peripheral margin (6) and the housing (2), mechanical fasteners, releasably matable hook material (35) and loop material (36), such as VELCRO®, or other like attachment elements. The peripheral margin (6) of the protective member (5) can, but need not necessarily, be substantially continuous or continuous and correspondingly continuously engage the perimeter of the housing (2). In particular embodiments, the peripheral margin (6) of the protective member (5) can be interrupted or discontinuous and the perimeter margin (6) engaging the perimeter of the housing (2) can have one or a plurality of attachment points. The length of the peripheral margin (6) can, but need not necessarily, be substantially equal to the corresponding perimeter length of the housing (2).

In particular embodiments, the flexible member body (7) can, but need not necessarily, include a flexible body bottom portion (37) extending to a flexible body bottom portion periphery (38). The flexible body bottom portion periphery (38), can, but need not necessarily, extend to the corresponding peripheral edge (31) of the motion element (4), thereby bounding substantially equal areas of similar configuration. A flexible body top portion (39) can extend from the flexible body bottom portion periphery (38) to the peripheral margin (6). The flexible body bottom portion internal surface (33*a*) and the flexible body top portion internal surface (33*b*) can define the protective member interior space (8) having a volume sufficient to receive the motion element (4) and permit movement of the motion element (4) in response to operation of the drive unit (3).

Now referring primarily to FIG. 9, particular embodiments of the protective member (5) can further include a peripheral margin adjustment assembly (40). The peripheral margin adjustment assembly (40) can be coupled to the peripheral margin (6) of the protective member (5) allowing adjustment of the peripheral margin (6). The peripheral margin adjustment assembly (30) can be operated to position the peripheral margin (6) of the protective member (5) to allow releasable fixed securement or attachment to the housing (2).

Again referring primarily to FIG. 9, in particular embodiments, the peripheral margin (6) can be discontinuous defining a distance between a pair of peripheral margin ends (41)(42). The peripheral margin adjustment assembly (40) can be operated to increase or decrease the distance between the pair of peripheral margin ends (41)(42) to attach or release the peripheral margin (6) against the perimeter of the housing (2). In particular embodiments, the peripheral margin (6) can have a length disposed between a peripheral margin first end (41) and a peripheral margin second end (42). The peripheral margin adjustment assembly (40) can include a first portion (43) releasably matable to a second portion (44). The first portion (43) can be coupled to the peripheral margin first end (41). The second portion (44) can be coupled to the peripheral margin second end (42). In particular embodiments, each of the first portion (43) and the second portion (44) can include a length of pliable material (45). The pliable material (45) can permit the first portion (43) and the second portion (44) to be knottingly engaged. In particular embodiments, the first portion (43) can be a hook, the second portion (44) can be a hook catch, and the hook and hook catch can be reversibly engaged.

Again referring primarily to FIG. 9, in particular embodiments, the peripheral margin adjustment assembly (40) can, but need not necessarily, include fastenably matable first and second portions (43)(44). The first portion (43) can be attached to the peripheral margin first end (41). The second portion (44) can be attached to the peripheral margin second end (42). Each of the first and second portions (43)(44) can correspondingly extend outward of the peripheral margin first and second ends (41)(42) terminating in a corresponding first portion terminal end (45) and a second portion terminal end (46). The first and second portions (43)(44) can be fastenably mated by overlappingly engaging all or a part of the first portion (43) over all or a part of the second portion (44) in an overlap area (47) disposed between each of the first portion and second portion terminal ends (45)(46). By increasing the distance between each of the first portion and second portion second terminal ends (45)(46) (increasing the overlapping part), the distance between peripheral margin first and second ends (41)(42) can be decreased. Conversely, decreasing the distance between each of the first portion and second portion second terminal ends (45)(46) (decreasing the overlapping part), the distance between peripheral margin first and second ends (41)(42) can be increased.

The illustrative example of FIG. 9, shows embodiments of a fastenably matable peripheral margin adjustment assembly (40). The first portion (43) of the peripheral margin adjustment assembly (40) includes a loop material (36). The second portion (44) of the peripheral margin adjustment assembly (40) includes a hook material (35). The first portion (43) can overlappingly engage the second portion (44). The overlap area (47) disposed between each of the first portion and second portion (43)(44) can be releasably fastenably mated by engaging the hook material (35) and the loop material (36) of an overlap area (47).

In particular embodiments, the first portion (43) can include a plurality of apertures (50) disposed serially in the first portion (43). The second portion (44) can include a one or more projecting members (51) disposed serially on the second portion (44). By varying as to which of the plurality of apertures (50) the one or more projecting members (51) are inserted into, the overlap area (47) can be correspondingly varied. The examples of peripheral margin adjustment assemblies (40) including fastenably matable first and second portions (43)(44) are not intended to preclude other alternative fastenably matable peripheral margin adjustment assemblies (40) which operate to adjust the distance between the peripheral margin first and second ends (41)(42).

Figure 12:
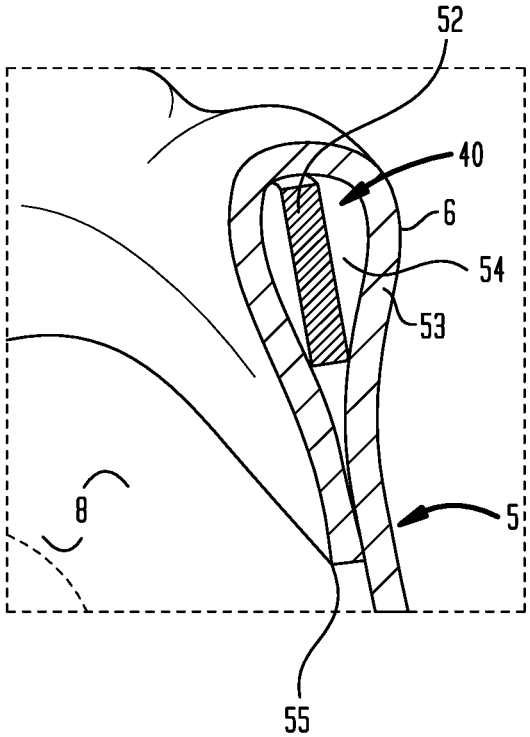
FIG. 12 is a cross-sectional view 11-11 of a particular embodiment of a protective member.

Now referring primarily to FIGS. 11 and 12, particular embodiments of the protective member (6) can, but need not necessarily include, an elastic element (52) coupled to or integral to the peripheral margin (6). The elastic element (52) can be elastically stretchable to allow the peripheral margin (6) of the protective member (5) to be secured about the housing (2). In particular embodiments, the elastic element (52) can, but need not necessarily, be integral in the material used in the peripheral margin (6) of the protective member (5), such as neoprene or materials such as SPANDEX® or LYCRA®. In particular embodiments, the elastic element (52) can, but need not necessarily, be a discrete element coupled to the surface of the peripheral margin (6) or disposed within a peripheral margin pocket (53). The peripheral margin pocket (53) can define a pocket interior space (54) sufficient to receive the elastic element (52). In particular embodiments, the material of the peripheral margin (6) can be folded and joined proximate the peripheral edge (55) to create the peripheral margin pocket (53) and the elastic element (52) can be drawn through the pocket interior space (54); however this illustrative example is not intended to preclude embodiments of the peripheral margin pocket (53) constructed by joining discrete pieces of material. The peripheral margin pocket (53) can extend the length of the peripheral margin (6).

Now referring generally to FIGS. 1 through 11, methods of using a protective cover system (1) can include obtaining a housing (2), a drive unit (3) disposed in the housing (2), a motion element (4) responsive to the drive unit (3), and obtaining a protective member (5) having a flexible body internal surface (33) defining a protective member interior space (8) adapted to receive the motion element (4) and having a peripheral margin (6) adapted to attach to the housing (2). The method can further include receiving or disposing the motion element (4) inside the protective member interior space (8) of the protective member (5), and attaching the peripheral margin (6) of the protective member (5) to the housing (2). In particular embodiments which include a peripheral margin adjustment assembly (40), methods of using a protective cover system (1) can further include operating the peripheral margin adjustment assembly (40) to adjust the peripheral margin (6) to secure the peripheral margin (6) to the housing external surface (9) of the housing (2). In particular embodiments in which the peripheral margin (6) terminates in peripheral margin first and second ends (41)(42) the method can further include mating fastenable first and second portions (43)(44) of the peripheral margin adjustment assembly (40) to increase or decrease distance between peripheral margin first and second ends (41)(42) to secure the peripheral margin (6) against the housing (2). In particular embodiments in which the peripheral margin adjustment assembly (40) includes an elastic element (52), the method of using a protective cover system (1) can include elastically stretching the elastic element (42) to dispose the peripheral margin (6) in secured engagement about the housing (2).

Now referring primarily to FIG. 1, the method of using embodiments can further including operating the drive unit (3) to generate motion (17) in the motion element (4) disposed inside of the protective member interior space (8) of the protective member (5). In particular embodiments, the method can further include engaging the flexible body external surface (34) to an object (57) to transfer forces of or from movement of the motion element (4) through the protective member (5) to the object (57). In particular embodiments, the object (57) can be a human or non-human animal (58). The protective cover system (1) including the protective member (5) confers a substantial advantage in that an object (57) may include entanglement features (56) that can be entangled in the operation of the drive unit (3) or the motion element (4) or the combination. The protective member (5) precludes entangled engagement of such entanglement features with the drive unit (3), or the motion element (4), or the combination or components thereof. As one illustrative example, in which the object (57) is an animal (58) having hair or fur (59), the protective member (5) has a structure or function that prevents entanglement of the hair or fur with the drive unit (3), or the motion element (4), or combinations or components thereof.

As can be easily understood from the foregoing, the basic concepts of the present invention may be embodied in a variety of ways. The invention involves numerous and varied embodiments of a protective cover system including a protective member and methods for making and using such protective cover system including such protective member including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "cover" should be understood to encompass disclosure of the act of "covering"—whether explicitly discussed or not—and, conversely, were there effectively disclosure of the act of "covering", such a disclosure should be understood to encompass disclosure of a "cover" and even a "means for covering." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the protective cover systems herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A protective cover system, comprising:

a housing including a pass-through aperture defining a handle;

a drive unit disposed within said housing;

a motion element coupled to said drive unit, said motion element disposed external to and moving relative to said housing;

a protective member having a flexible member body having a closed end and extending to a flexible peripheral margin, said flexible member body defining an interior space adapted to receive said motion element, said flexible peripheral margin of said protective member having a length disposed between a pair of peripheral margin ends, said handle received between said pair of peripheral margin ends; and a peripheral margin adjuster coupled to said pair of peripheral margin ends operable to decrease distance between said pair of peripheral margin ends to releasably secure said flexible peripheral margin of said protective member directly to an external surface of said housing, said peripheral margin adjuster including fastenably matable first and second portions, each of said first and second portions having a length disposed between a first end correspondingly attached to said pair of peripheral margin ends and a second terminal end, said first and second portions disposable in said pass-through aperture and fastenably mated to releasably secure said peripheral margin directly to said external surface of said housing.

2. The system of claim 1, wherein said first portion includes a plurality of loops, wherein said second portion includes a plurality of hooks, and said plurality of loops releasably fasten to said plurality of hooks.

3. A method of making a protective cover system, comprising:

obtaining a protective cover system, comprising:

a housing including a pass-through aperture defining a handle;

a drive unit disposed within said housing;

a motion element coupled to said drive unit, said motion element disposed external to and moving relative to said housing;

a protective member having a flexible member body having a closed end and extending to a flexible peripheral margin, said flexible member body defining an interior space adapted to receive said motion element, said flexible peripheral margin of said protective member having a length disposed between a pair of peripheral margin ends, said handle received between said pair of peripheral margin ends;

a peripheral margin adjustment assembly coupled to said pair of peripheral margin ends operable to decrease distance between said pair of peripheral margin ends to releasably secure said flexible peripheral margin of said protective member directly to an external surface of said housing, said peripheral margin adjustment assembly including fastenably matable first and second portions, each of said first portion and said second portion having a length disposed between a first end correspondingly attached to one of said pair of peripheral margin ends and a second terminal end;

disposing said motion element in said interior space of said protective member; and disposing said first and second portions in said pass-through aperture and fastenably mating said first portion to said second portion to releasably secure said peripheral margin directly to said external surface of said housing.

4. The method of claim 3, further comprising operating said peripheral margin adjuster to decrease distance between a pair of peripheral margin ends to directly secure said peripheral margin about said housing.

* * * * *